US005510823A

United States Patent [19]

Tanaka et al.

[11] Patent Number: 5,510,823

[45] Date of Patent: Apr. 23, 1996

[54] PASTE FOR RESISTIVE ELEMENT FILM

[75] Inventors: Hiroyuki Tanaka; Kaoru Torikoshi; Fumiaki Tambo; Katsuhiro Sato; Yutaka Akasaki, all of Minami Ashigara, Japan

[73] Assignee: Fuji Xerox Co., Ltd., Tokyo, Japan

[21] Appl. No.: 841,465

[22] Filed: Feb. 26, 1992

[30] Foreign Application Priority Data

| | | | |
|---|---|---|---|
| Mar. 7, 1991 | [JP] | Japan | 3-041680 |
| Mar. 7, 1991 | [JP] | Japan | 3-041681 |
| Mar. 7, 1991 | [JP] | Japan | 3-041682 |
| Mar. 7, 1991 | [JP] | Japan | 3-041683 |

[51] Int. Cl.[6] ..... B41J 2/335; H01C 7/00; H01C 7/06

[52] U.S. Cl. ..... 346/141; 338/308; 427/226; 427/126.1; 427/126.5; 252/506; 252/507; 252/510; 252/514; 252/518; 252/520

[58] Field of Search ..... 346/76 PH; 252/506, 252/507, 514, 518, 520, 510; 347/204; 338/308; 427/226, 126.5, 126.1; 219/543

[56] References Cited

U.S. PATENT DOCUMENTS

| | | | |
|---|---|---|---|
| 3,776,772 | 12/1973 | Asada et al. | 252/514 |
| 5,189,284 | 2/1993 | Takahashi et al. | 347/204 |

FOREIGN PATENT DOCUMENTS

| | | |
|---|---|---|
| 50-30094 | 3/1975 | Japan . |
| 53-100496 | 9/1978 | Japan . |
| 54-119695 | 9/1979 | Japan . |
| 55-63804 | 5/1980 | Japan . |
| 57-27505 | 2/1982 | Japan . |
| 58-19813 | 2/1983 | Japan . |
| 60-102702 | 6/1985 | Japan . |
| 60-102701 | 6/1985 | Japan . |
| 62-292453 | 12/1987 | Japan . |
| 56-5354 | 1/1989 | Japan . |
| 64-54710 | 3/1989 | Japan . |
| 1-152074 | 6/1989 | Japan . |
| 1-220402 | 9/1989 | Japan . |
| 1-286402 | 11/1989 | Japan . |
| 2-39953 | 2/1990 | Japan . |
| 2-33902 | 2/1990 | Japan . |
| 2-33901 | 2/1990 | Japan . |

*Primary Examiner*—Huan H. Tran
*Attorney, Agent, or Firm*—Oliff & Berridge

[57] ABSTRACT

A resistive element film-forming paste includes (1) an organic metal compound, (2) at least one organic non-metal additive, and (3) a solution of asphalt in a solvent. A resistive element is formed by coating the paste on a substrate followed by calcining.

18 Claims, 2 Drawing Sheets

PASTE FOR RESISTIVE ELEMENT FILM

FIELD OF THE INVENTION

The present invention relates to a resistive element for use in various electronic components such as hybrid integrated circuit and thermal head and a material and method for forming the film of such a resistive element.

More particularly, the present invention relates to a screen-printable resistive film-forming paste for the formation of a resistive element film, wherein the film-forming material is coated on a substrate such as alumina and glass by screen printing method or the like, and then calcined to form a resistive element film made of a metal oxide in any shape thereon.

BACKGROUND OF THE INVENTION

Heretofore, as methods for the formation of a resistive metal oxide film for use in hybrid integrated circuit and various electronic apparatus there have been well-known a thick film-forming process which comprises screen-printing on a substrate a paste obtained by mixing a mixture of a metal and/or metal oxide powder and glass with a resin solution as a binder, and then calcining the material to form a film thereon and a thin film-forming process utilizing the sputtering of a resistive element film-forming material.

In the former process, as disclosed in JP-A-53-100496 and 54-119695 (the term "JP-A" as used herein means an "unexamined published Japanese patent application"), a thick resistive element film-forming paste comprising a mixture of a ruthenium oxide powder and a glass frit powder dispersed in an organic vehicle made of a mixture of a solvent and a resin is screen-printed on a substrate, and then calcined to form a resistive element thereon.

In the latter process, as disclosed in JP-A-55-63804, vacuum technique is applied. A thin film of a sparingly soluble metal such as tantalum is deposited on a substrate by a sputtering process, and a pattern is then formed by a photolithographic process to form a thin resistive element film thereon. This resistive element can be used for some kinds of thermal heads.

The former thick film-forming process with the conventional thick resistive element film-forming paste requires an inexpensive apparatus for forming resistive elements and provides a high reproducibility. However, this thick film process has disadvantage in that the resulting resistive element film has a thickness of about 10 μm or more. Furthermore, this process has disadvantage in that since the thick resistive element film-forming paste is an ununiform mixture of a glass frit powder and a ruthenium oxide powder, the resulting resistive value varies widely or the strength to electric field is low, that is, when the voltage applied is altered, the resistive value suddenly changes. Moreover, this process has disadvantage in that it is difficult to control the resistive value of the resulting resistive element by the composition ratio of a glass powder and a ruthenium oxide powder alone, and the difference in grain diameter between a glass powder and a ruthenium oxide powder or the variation of calcining temperature causes a great dispersion of resistive value. Even if the composition ratio and the average grain diameter are kept constant, the resistive value of the resulting resistive elements are different by lot.

The latter thin film-forming process can provide a uniform thin film resistive element. However, this process requires an expensive apparatus and provides a low reproducibility.

Heretofore, various techniques have been proposed for the preparation of thin resistive element films using the above mentioned thick film-forming process with an inexpensive production apparatus. One of these proposed techniques is MOD (Metallo Organic Deposition) process. MOD process is similar to the thick film-forming process. In MOD process, an organic metal compound solution is used instead of a mixture of metal and/or metal oxide and glass to prepare a paste from which a thin film is then formed (as disclosed in JP-A-60-102701, JP-A-60-102702, JP-A-62-292453, JP-A-1-152074, JP-A-2-39953, JP-A-2-33901, and JP-A-2-33902).

As another MOD process there has been known a process which comprises coating a solution containing an organic metal compound on a substrate, and heating and calcinating the material to cause the material to decompose to obtain a thin film of the corresponding metal oxide or the like (as disclosed in JP-A-64-54710, JP-A-1-286402, and JP-A-1-220402). It has been known that an iridium compound is used as an electrically-conductive component for thin resistive element film-forming material in this MOD process.

The above mentioned thick film-forming process using an organic metal compound solution has disadvantage in that the preparation of a paste suitable for screen printing finds difficulties in viscosity or storage stability. Thus, a proper viscosity adjuster is required to prepare a paste with an optimum viscosity and excellent storage stability. For example, as a viscosity adjuster builder for adjusting the viscosity of an electrically-conductive film-forming paste there has been known a cellulose compound such as ethyl cellulose (as disclosed in JP-A-56-5354, JP-A-57-27505, and JP-A-58-19813). Some resistive element films are prepared with asphalt as a viscosity adjuster. However, these resistive element films comprise a glass powder besides an organic metal compound solution to maintain proper film-forming properties (as disclosed in JP-A-50-30094).

Ethyl cellulose and the like to be used as a viscosity adjuster for screen printing paste in the formation of a thin film by the above mentioned thick film-forming process using an organic metal compound solution exhibit a poor compatibility and film-forming properties depending on the organic metal compound. The above mentioned resistive element film-forming paste with asphalt as a viscosity adjuster, which comprises glass powder besides an organic metal compound solution to maintain proper film-forming properties, provides a resistive element film with a poor uniformity resulting in a dispersion and in the resistive value of the resistive element film.

Furthermore, an iridium-containing resistive element film obtained according to MOD process which has heretofore been known exhibits only a relatively low resistive value. The resulting resistive element film cannot be used in integrated circuits for high voltage.

In order to accomplish the above mentioned objects, the inventors made an extensive study on what causes the dispersion in the resistive value of these resistive elements. As a result, the inventors suggested that the dispersion in the resistive value is mainly caused by two factors, that is, dispersion in the film thickness of the resistive element and ununiformity of properties related to the physical properties of thin film such as material composition of the resistive element.

It is considered that the dispersion in the film thickness of the resistive element is caused by the dispersion in the film thickness which has occured upon printing of the resistive paste and remained after calcination. Accordingly, it is necessary to solve problems causing the dispersion in the film thickness upon printing such as uneven printing of the resistive paste.

SUMMARY OF THE INVENTION

One object of the present invention is to solve the above mentioned prior art problems and thus provide a paste suitable for the coating of a uniform resistive element film with a small dispersion in the resistive value.

Another object of the present invention is to provide a resistive element film-forming material which can provide a uniform resistive element film with a great adhesive strength to a substrate and an excellent electrical properties, i.e., high resistive value.

Further object of the present invention is to provide a resistive element comprising the above mentioned paste or resistive element-forming material and an electronic component such as thermal head comprising said resistive element.

These and other objects of the present invention will become more apparent from the following detailed description.

In order to accomplish these objects of the present invention, the present invention has the following constitutions:

1. A resistive element film-forming material, which comprises (1) an organic metal compound, (2) at least one additive selected from organic nonmetal compounds and organic metal compounds, and (3) a solution of asphalt dissolved in a solvent.
2. A resistive element, which comprises a substrate having thereon a resistive element film made of finely divided resistive element grains with a diameter of 100 Å or less.
3. A resistive element film-forming material, which comprises (1) an organic iridium (Ir) compound and (2) a compound containing at least one element (M) selected from the group consisting of silicon (Si), bismuth (Bi), lead (Pb), aluminum (Al), zirconium (Zr), calcium (Ca), tin (Sn), boron (B), titanium (Ti) and barium (Ba), with the ratio of the number of atoms in said elements (M) to the number of iridium atom in said organic iridium (Ir) compound being in the range of 2.7 to 5.
4. A resistive element, formed by a process which comprises coating a resistive element film-forming paste comprising (1) an organic metal compound, (2) at least one additive selected from organic nonmetal compounds and organic metal compounds, and (3) a solution of asphalt dissolved in a solvent on a substrate, and then calcining the material.
5. An electronic component, comprising a resistive element formed by a process which comprises coating a resistive element film-forming paste comprising (1) an organic metal compound, (2) at least one additive selected from organic nonmetal compounds and organic metal compounds, and (3) a solution of asphalt in a solvent on a substrate, and then calcining the material.
6. An electronic component, comprising substrate having thereon a resistive element made of a resistive element film formed of finely divided grains with a diameter of 100 Å or less.
7. A resistive element, formed by a process which comprises coating on a substrate a resistive element film-forming material, which comprises (1) an organic iridium (Ir) compound and (2) a compound containing at least one element (M) selected from the group consisting of silicon (Si), bismuth (Bi), lead (Pb), aluminum (Al), zirconium (Zr), calcium (Ca), tin (Sn), boron (B), titanium (Ti) and barium (Ba), with the ratio of the number of atoms in said elements (M) to the number of iridium atom in said organic iridium (Ir) compound being in the range of 2.7 to 5, and then calcining the material.
8. A thermal head, comprising (1) a substrate, (2) a thin glass film provided on said substrate, and (3) a resistive element film provided on said thin glass film and having a means of conducting electric current to said resistive element film, wherein said resistive element film comprises finely divided grains with a diameter of 100 Å or less.
9. A thermal head, comprising (1) a substrate, (2) a thin glass film provided on said substrate, and (3) a resistive element film provided on said thin glass film and having a means of conducting electric current to said resistive element film, wherein said resistive element film is formed by a process which comprises coating on said thin glass film a resistive element film-forming material comprising (1) an organic iridium (Ir) compound and (2) a compound containing at least one element (M) selected from the group consisting of silicon (Si), bismuth (Bi), lead (Pb), aluminum (Al), zirconium (Zr), calcium (Ca), tin (Sn), boron (B), titanium (Ti) and barium (Ba), with the ratio of the number of atoms in said elements (M) to the number of iridium atom in said organic iridium (Ir) compound being in the range of 2.7 to 5, and then calcining the material.

BRIEF DESCRIPTION OF THE DRAWINGS

By way of example and to make the description more clear, reference is made to the accompanying drawings in which:

An example of the use of a heating resistive element obtained in Examples III-1 and IV-1 in a thermal head will be described. FIG. 2 is a plan view of the main part of the thermal head, and FIG. 3 is a sectional view taken along the line X-y of FIG. 2. In these figures, the reference numeral 3 shows a common electrode, the reference numeral 4 shows an opposing electrode, the reference numeral 5 shows a heating resistive element, the reference numeral 6 shows an alumina substrate, the reference numeral 7 shows an under glazed layer, and the reference numeral 8 shows an over glazed layer. This thermal head is prepared as follows:

Figure 1:
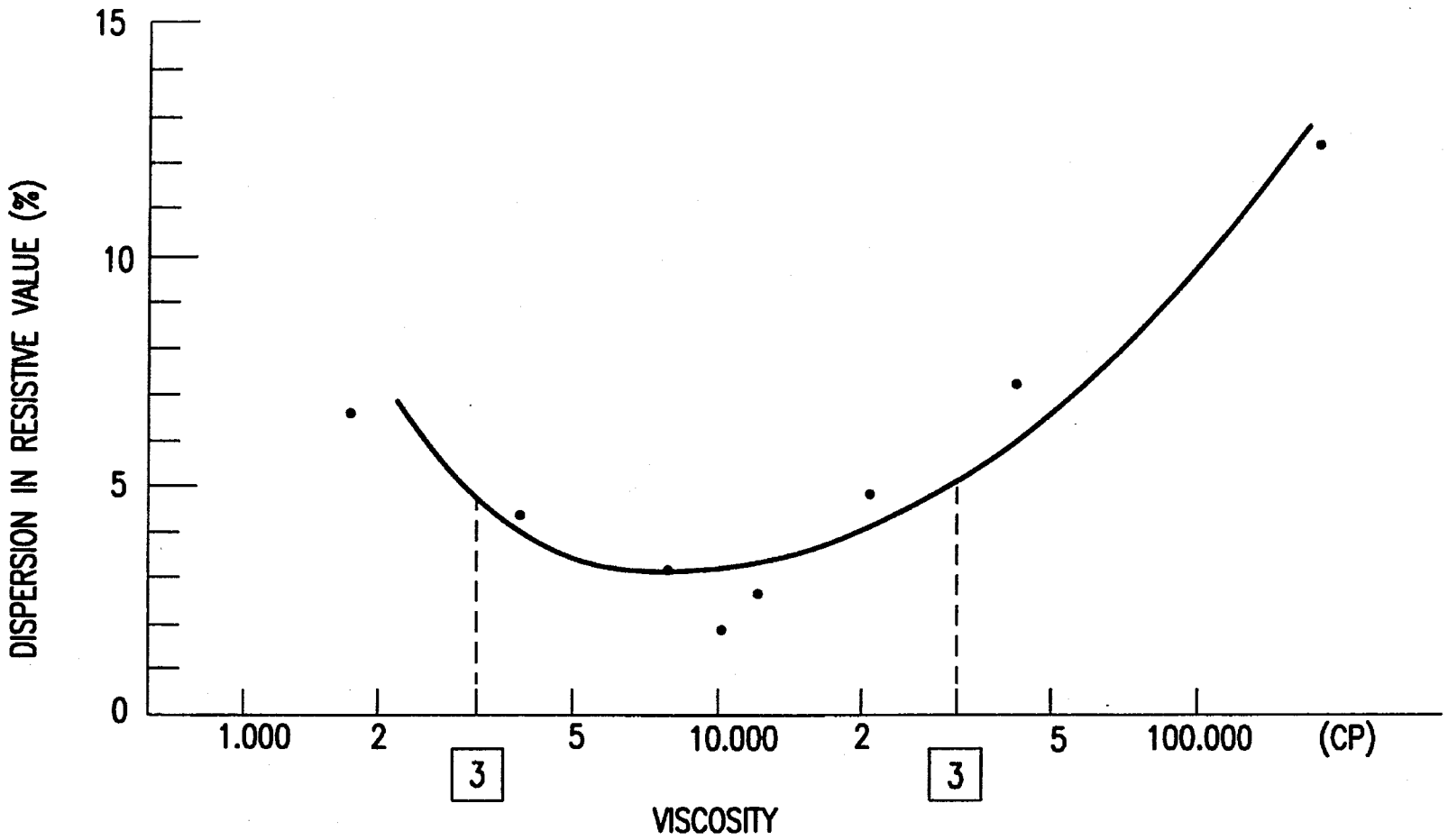
FIG. 1 illustrates the relationship between the viscosity and the dispersion in the resistive value of a resistive element film-forming paste of the present invention.
Figure 2:
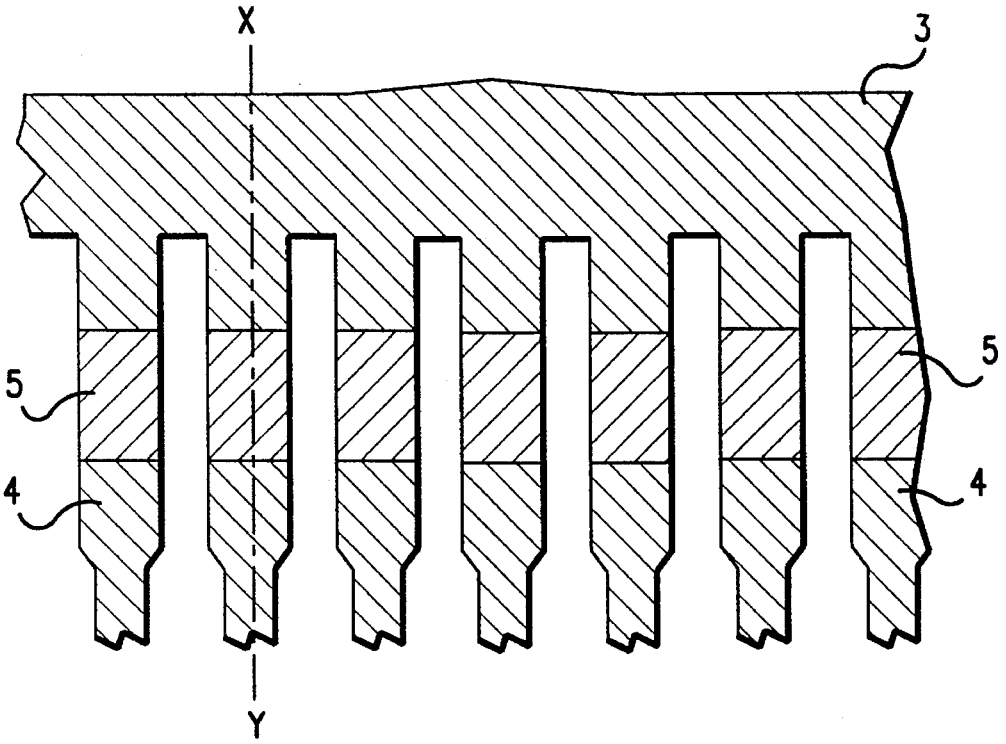
FIG. 2 is a plan view of the main part of a thermal head according to the present invention.
Figure 3:
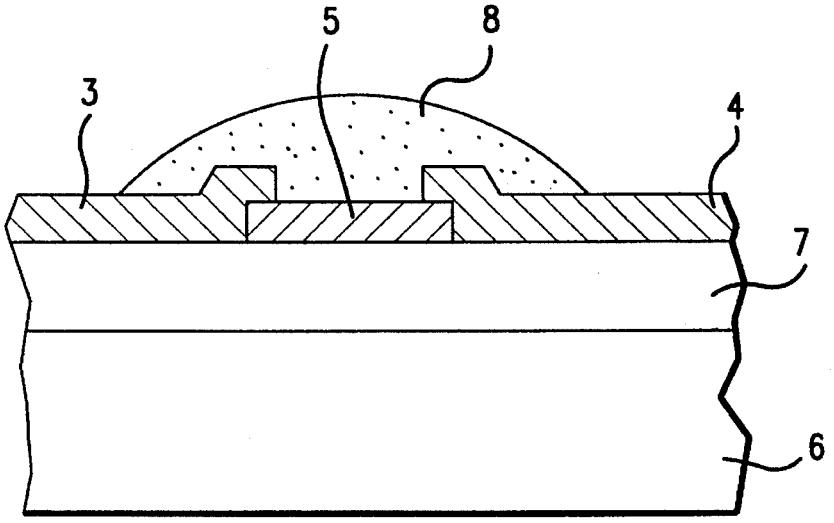
FIG. 3 is a sectional view taken along the line X-Y of FIG. 2.

Firstly, a resistive element film is formed as heating resistive element 5 on a glazed alumina substrate (alumina substrate 6 having thereon glazed layer 7 formed) by the method as described in Examples III-1 and IV-1. The material is then subjected to resist coating, exposure, and development to obtain a resist pattern. The resistive element is then etched with fluoronitric acid as an etching solution to obtain a resistive element pattern with 8 to 25 dot/mm. A metallo-organic gold paste D27 produced by Noritake Company Limited is then rush-printed on the resistive element, and then calcined to form a gold film thereon. The material is then subjected to resist coating, exposure, and development to obtain a resist pattern of conductors for common electrode 3 and opposing electrode 4. The material is then etched with a solution of iodine-potassium iodide [$I_2$—KI] as an etching solution to form a conductor pattern. As a protective film, a glass paste 490BH produced by Electro Science Laboratory is printed on the material, and then calcined to form over glazed layer 8 thereon to complete a thermal head. The resistive element film on the thermal head thus obtained exhibits a reduced dispersion in the resistive value and a reduced fluctuation in the resistive value depending on the electric power. An individual opposing heating resistive element which is difficult to prepare in the thick film-forming process can be easily obtained by the etching process. Thus, the generation of heat from adjacent heads is reduced, improving the picture quality.

DETAILED DESCRIPTION OF THE INVENTION

Examples of the organic metal compound to be used in the present invention include carboxylates, diketone chelate compounds, alkoxide compounds and mercaptide compounds of at least one element selected from the group consisting of Ir, Rh, Ru, Pt, Pd, and Os. As a solvent for the organic metal compound there may be preferably used a high boiling solvent capable of dissolving these organic metal compounds. Examples of the high boiling solvent include terpineol, benzyl acetate, isophorone, butylcarbitol acetate, benzyl alcohol, etc. These solvents can be used singly or in combination. Examples of the organic metal or non-metal compound to be used as additive element include carboxylates, diketone chelate compounds, alkoxide compounds and mercaptide compounds of at least one element selected from the group consisting of Bi, Si, Pb, Ti, B, Ba, Al, Zr, and Ca. Instead of the organic metal compound and organic non-metal compound, a commercial metal resinate or non-metal resinate containing the respective compound may be used.

Besides the above constituents of the resistive element film-forming paste, an anti-foaming agent, a leveling agent, and other additives may be incorporated in the system for the purpose of improving printability.

The method for preparing the resistive element film can be accomplished by coating the above resistive element film-forming paste on a substrate using a screen printing method, a dip coating method, a spin coating method, a bar coating method, or the like, drying the material, and then calcining the material at a temperature not lower than the thermal decomposition temperature of the organic metal compound, organic non-metal compound or additives.

As the viscosity adjuster, asphalts are preferably used. Examples of other viscosity adjusters which can be used in combination with asphalt include cellulose compounds such as ethyl cellulose, nitro cellulose and carboxymethylcellulose, general-purpose polymers such as polyethylene, polystyrene, polypropylene, polymethylene methacrylate, polyethyl methacrylate and polycarbonate, and natural high molecular compounds such as resin. In the present invention, the viscosity of the paste can be adjusted to 3,000 to 30,000 cp by using asphalt as a viscosity adjuster. As a solvent for dissolving the viscosity adjuster therein, preferably a high boiling solvent such as terpineol, benzyl acetate and isophorone is preferably used. These solvents can be used singly or in combination. In the present invention, the measurement of viscosity can be accomplished by means of a Type RHEOMAT115 coneplate type viscometer. The specified viscosity range is $1\times10\ s^{-1}$ as calculated in terms of number of revolutions.

The asphalt to be used in the present invention is a mixture of three main components, i.e., (1) an oily component such as medium, petrolene and malten, (2) a protective material such as asphalt resin and asphaltic acid, and (3) colloidal grains or ultrafinely divided grains of carbon such as asphaltene, carbene and pyrrobitumen. Specific examples of such an asphalt include natural asphalts such as rock asphalt, asphaltite, gilsonite, granspitch and graphamite. These natural asphalts can be used as they are. Furthermore, straight asphalt obtained as a residue by a process which comprises subjecting asphalt base crude oil to distillation under normal pressure and steam or vacuum distillation, petroleum asphalt such as blown asphalt obtained by a process which comprises blowing air into the residue at an elevated temperature to effect oxidation polymerization, and cut-back asphalt obtained by blending petroleum asphalt with distillate oil such as kerosene to improve the fluidity thereof can be used.

The above asphalts can be preferably used after filtering using a filter having preferably a pore diameter (i.e., a mesh size) of 10 μm or less and more preferably about 2 μm by a method such as a suction filtration (e.g., a filtration under reduced pressure) or a filtration under pressure. In the pore diameter of filter, the above size is preferred in view of time of filtration because if the mesh size is too small, the time of filtration is prolonged.

As a material of the filter, materials which are not eroded by a solvent used such as a Teflon (i.e., PTFE (tetrafluoroethylene)) fiber, a polypropylene fiber and an inorganic fiber are preferably used.

The effective filtering area is preferably increased for shortening the time of filtration. When an amount of the asphalts filtered is small (i.e., from 1 g to several tens g), the effective filtering area is preferably 0.8 $cm^2$. Also, when the amount of the asphalts filtered is large (i.e., about 100 g or more), the filtration under pressure (pressure: about 4.5 $kg/cm^2$) is preferably used as filtering means.

Examples of the filter include HDC-DFA Filter manufactured by Japan Pole Co., Ltd. (pore diameter (mesh size): 1.2 μm, Polypropylene fiber, Effective filtering area: 930 $cm^2$).

The resistive element of the present invention comprises a resistive element comprising finely divided grains with a diameter of 100 Å or less, preferably 10 Å to 100 Å, formed on a substrate.

The above finely divided grains of resistive element contain oxide of platinum group metals and oxide of at least one element selected from the group consisting of silicon (Si), bismuth (Bi), lead (Pb), tin (Sn), aluminum (Al), boron (B), titanium (Ti), zirconium (Zr), calcium (Ca) and barium (Ba) as additives.

The above oxide of platinum group metals include at least one oxide selected from the group consisting of oxide of iridium (Ir), rhodium (Rh), platinum (Pt), palladium (Pd) and osmium (Os).

Furthermore, the present invention provides a process which comprises coating on a substrate a resistive element film-forming paste comprising at least one organic compound of metal selected from the group consisting of ruthenium (Ru), iridium (Ir), rhodium (Rh), platinum (Pt), palladium (Pd) and osmium (Os) and at least one compound selected from the group consisting of compounds containing elements such as silicon (Si), bismuth (Bi), lead (Pb), tin (Sn), aluminum (Al), boron (B), titanium (Ti), zirconium (Zr), calcium (Ca) and barium (Ba), drying the material, and then optionally calcining the material. The present invention also provides the above process wherein said resistive element film-forming paste contains as additive an viscosity adjuster such as asphalt or a printability improver. The present invention further provides an electronic component comprising said resistive element. The present invention further provides a thermal head comprising a means for conducting electric current to said resistive element.

As the above mentioned organic metal compound there can be arbitrarily selected known-compounds which have been heretofore known. For example, organic metal compounds made of metal alkoxide, octylate, naphthenate, metal acetyl acetonate, etc. can be used. As the compound to be used as additive component there can be used a compound made of these additive elements as in the case of the above organic metal compounds. Besides the above viscosity adjuster, compounds which are commonly used in the coating and printing industries may be used as printability improvers, singly or in combination.

As such printability improvers, organic acids such as stearic acid and arachidic acid, 2,2,4-trimethylpentane-1,3-diol-monobutyl ester, etc. can be preferably used.

As the above organic solvent there can be used any organic solvent which can dissolve the organic metal compounds, viscosity adjuster and printability improvers therein. In the light of printability and dryability, organic solvents having a proper boiling point (i.e., 100° C. or more and preferably 150° to 300° C.) may be preferably used. For example, organic solvents which are commonly used for screen printing paste such as toluene, xylene, butyl carbitol acetate, isophorone, benzoyl acetate, terpineol and triethylene glycol monomethyl ether can be used.

One of the features of the present invention is that the resistive element film prepared from the above resistive element film-forming paste is observed using a high resolution transmission type electron microscope to comprise finely divided grains of resistive element having a diameter of 100 Å or less. The resistive element film of the present invention comprising a large number of such ultrafinely divided grains has a very dense structure, and its surface is very smooth. Furthermore, the film properties such as metal composition ratio, crystallizability and film thickness of the resistive element film are considered to be very uniform.

Because of its uniformity in the resistive value, the resistive element prepared according to the present invention, though prepared by the thick film-forming process, serves as an excellent resistive element that stands comparison with those prepared by the thin film-forming process. It was confirmed that this resistive element can provide any patterning with an etching solution commonly used in the manufacture of semiconductors. Thus, this resistive element can be used for a patterned thermal head with an excellent heat dissipation property, a high resolution and a multiple gradation which is impossible with the conventional resistive element.

In addition, the present invention provides a resistive element film-forming material comprising an organic iridium (Ir) compound and a compound containing at least one element (M) selected from the group consisting of silicon (Si), bismuth (Bi), lead (Pb), aluminum (Al), zirconium (Zr), calcium (Ca), tin (Sn), boron (B), titanium (Ti) and barium (Ba), wherein the ratio of the number of atoms in said elements (M) to the number of iridium atom in said organic iridium (Ir) compound is in the range of 2.7 to 5. The present invention also provides the above resistive element film-forming material, which comprises asphalt as an additive. The present invention further provides a resistive element film formed by a process which comprises coating the above resistive element film-forming material on a substrate, and then optionally calcining the material. The present invention further provides an electronic component comprising the above resistive element film. The present invention further provides a thermal head comprising a means for conducting electric current to the above resistive element film.

As the solution of the compound of metal or the like there can be used a solution of a metal resinate produced by N.E. CHEMCAT CORPORATION, carboxylate of iridium or other metals of the following chemical structures (1) to (7) ((1) iridium complex, (2) aluminum complex, (3) boron complex, (4) titanium complex, (5) zirconium complex, (6) calcium complex, (7) tin complex), diketone chelate compound, alkoxide compound, mercaptide compound, or the like.

As solvent for paste there may be preferably used a high boiling solvent (having preferably 100° C. or more and more preferably 150° to 300° C.) which can dissolve the organic metal or non-metal compound therein. For example, terpineol, benzyl acetate, isophorone, butyl carbitol acetate, benzyl alcohol, etc. can be used singly or in admixture.

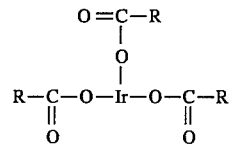
(1)

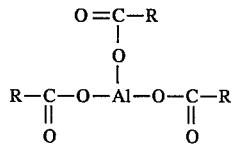
(2)

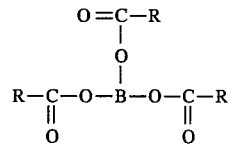
(3)

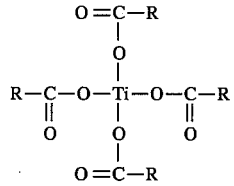
(4)

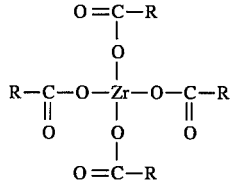
(5)

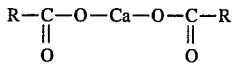
(6)

-continued

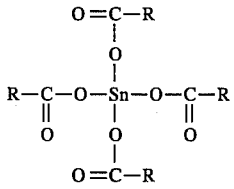

(7)

In the present invention, a solution containing at least an organic metal compound, among an organic metal compound and an organic non-metal compound is mixed with a solution of asphalt in a solvent as an additive to provide a viscosity and thixotropic properties suitable for coating. Thus, a paste is prepared. This paste is coated on a substrate, and then calcined to obtain a resistive element film.

The addition of asphalt provides a uniform paste with a viscosity and thixotropic properties suitable for coating which gives a film having an excellent surface properties and a reduced dispersion in the thickness when coated. After calcined, the material gives a resistive element film with a reduced dispersion in the resistive value. The addition of asphalt also provides excellent film-forming properties upon calcination.

The viscosity range of the resistive element film-forming paste is adjusted to 3,000 to 30,000 cp by the addition of asphalt. The resulting paste is printing-coated on a substrate, and then calcined. Since the above mentioned paste has been adjusted to an optimum viscosity, it can provide a film with excellent surface properties and a reduced dispersion in the film thickness when screen-printed or otherwise coated on a substrate. As a result, the calcined resistive element film exhibits a reduced dispersion in the resistive value.

The resistive element film-forming material of the present invention is coated on an insulating substrate, dried, and then calcined to form resistive element film thereon. By determining the composition ratio of the components in the resistive element film-forming material such that the content of other additive element oxides as glass components is great as compared with that of iridium oxide as the electrically conductive component in the resistive element film, the resistive element film can easily have a high resistive value.

The dissolution of asphalt in the resistive element film-forming material provides an improved printability and a uniform film thickness after calcination resulting in a reduced dispersion in the resistive value.

If the ratio (M/Ir) of the number of atoms of the at least one of the other additive metal elements (M) to that of iridium (Ir) falls below 2.7, a resistive element film with a high resistive value cannot be obtained. On the contrary, if this value (M/Ir) exceeds 5, the resistive element film shows an island shaped coagulation that causes poor film-forming properties.

The resistive value of the resistive element film of the present invention varies widely depending on the kind of the metal (M) and thus cannot be unequivocally determined. However, as the weight ratio of the metal (M) increases, the resistive value of the resistive element film increases. Thus, when M/Ir is 2.7 or more, a resistive element film having a resistive element value of 1KΩ or more can be obtained.

In Example I-1, the resistive value of resistive element films obtained with the composition ratios M/Ir and Ir/Bi/Si varied and its dispersion were determined. The results are set forth below:

| M/Ir | Ir/Bi/Si | Resistive value/ dispersion (Ω/□)/(%) |
|---|---|---|
| Ir content varied: | | |
| 0.67 | 3/1/1 | 327/3.4 |
| 1 | 2/1/1 | 389/2.3 |
| 1.33 | 1.5/1/1 | 420/3.4 |
| 4 | 0.5/1/1 | 1,401/4.4 |
| Si content varied: | | |
| 1.5 | 1/1/0.5 | 520/6.7 |
| 2.1 | 1/1/1.1 | 680/4.9 |
| 2.5 | 1/1/1.5 | 694/4.4 |
| 4 | 1/1/3 | 2,365/11.8 |
| Bi content varied: | | |
| 1.5 | 1/0.5/1 | 787/2.4 |
| 2.5 | 1/1.5/1 | 962/6.1 |
| 3 | 1/2/1 | 1,236/4.0 |
| 3.4 | 1/2.4/1 | 1,452/1.2 |
| 4 | 1/3/1 | 2,119/2.5 |

The present invention will be further described in the following examples, but the present invention should not be construed as being limited thereto.

EXAMPLE I-1

An asphalt solution as a viscosity adjuster was prepared as follows:

| | |
|---|---|
| Asphalt (Fine Powder: produced by Tokyo Kasei K.K.) | 150 g |
| α-Terpineol (produced by Tokyo Kasei K.K.) | 600 ml |

The above components were heated to a temperature of 150° C. with stirring for 3 hours to prepare an asphalt solution. The asphalt solution thus-obtained was mixed with 21.12 g of Ir resinate (A-1123: produced by N.E. CHEMCAT CORP.; metal content: 6.0 wt %), 6.89 g of Bi resinate (#8365: produced by N.E. CHEMCAT CORP.; metal content: 20.0 wt %), and 2.00 g of Si resinate (#28FC: produced by N.E. CHEMCAT CORP.; metal content: 9.3 wt %) as metal and non-metal resinates containing organic metal and non-metal compounds (Ir/Bi/Si=1/1/1 as calculated in terms of metal content in the resinates). The material was concentrated in a 100° C. dryer until the weight thereof was decreased to 60 wt %. To 18 g of the thus concentrated mixture containing Ir, Bi and Si was added 12.0 g of the above asphalt solution as a viscosity adjuster with stirring to obtain a resistive element film-forming paste.

The paste thus-obtained was screen-printed on a 1 in.×1 in. alumina substrate (GS-6: Kyocera Corp.) by means of a printer (PRESCO 8115, produced by AFFILATED MANUFACTURES, INC.), dried at a temperature of 70° C. for 30 minutes, and then calcined at a temperature of 800° C. for 15 minutes to obtain a resistive element film. The average sheet resistive value of the resistive element film and its dispersion were taken from the value of five specimens. The results are shown in Table I-2. The dispersion in the resistive value is obtained by dividing the standard deviation of resistive values by the average resistive value.

The measurement of viscosity was effected by means of a Type RHEOMAT115 coneplate type viscometer. The specified viscosity range is $1\times10\ s^{-1}$ as calculated in terms of number of revolutions.

EXAMPLE I-2

An asphalt solution was prepared in the same manner as in Example I-1 with the following exceptions:

Firstly, the asphalt solution as a viscosity adjuster was prepared by heating 150 g of asphalt (Fine Powder: produced by Tokyo Kasei K.K.) and 600 ml of α-terpineol (produced by Tokyo Kasei K.K.) to a temperature of 150° C. with stirring for 3 hours, and then to 500 ml of the solution thus-prepared was added 25 g of 2,2,4-tri-methylpentane-1, 3-diol-monobutyl ester (produced by Chisso Corporation). A paste was then prepared from the asphalt solution in the same manner as in Example I-1. A resistive element film was then prepared in the same manner as in Example I-1. The results of the sheet resistive value of the resistive element film thus obtained and its dispersion are shown in Table I-2.

EXAMPLES I-3 & I-4

Resistive element films were prepared in the same manner as in Example I-2 except that α-terpineol was replaced by benzyl acetate (produced by Tokyo Kasei K.K.) (in Example I-3) and isophorone (in Example I-4), respectively, in the preparation of the asphalt solution as a viscosity adjuster. The results of the sheet resistive value of the resistive element films thus-obtained and its dispersion are shown in Table I-2.

EXAMPLES I-5 & I-6

Resistive element films were prepared in the same manner as in Example I-2 except that the amount of the asphalt solution as a viscosity adjuster with respect to that of the concentrated mixture containing Ir, Bi and Si were altered as shown in Table I-1, respectively. The results of the sheet resistive value of the resistive element films thus-obtained and its dispersion are shown in Table I-2.

TABLE I-1

| Example | Concentrated mixture containing Ir, Bi and Si | Asphalt solution as viscosity adjuster |
|---|---|---|
| I-5 | 18 g | 18 g |
| I-6 | 21 g | 9 g |

Comparative Example I-1

A resistive element film was prepared in the same manner as in Example I-1 except that a paste with the same viscosity as obtained in Example I-1 was prepared by adding α-terpineol to the concentrated mixture containing Ir, Bi and Si without addition of asphalt solution. The results of the sheet resistive value of the resistive element film thus-obtained and its dispersion are shown in Table I-2.

Comparative Example I-2

A resistive element film was prepared in the same manner as in Example I-1 except that a paste with the same viscosity as obtained in Example I-1 was prepared by adding an α-terpineol solution of ethyl cellulose to the concentrated mixture containing Ir, Bi and Si in stead of the asphalt solution. The results of the sheet resistive value of the resistive element film thus obtained and its dispersion are shown in Table I-2.

TABLE I-2

| | Film quality after drying | Film quality after calcination | Average resistive value (Ω/□) | Dispersion in resistive value (%) |
|---|---|---|---|---|
| Example I-1 | Good | Good | 597 | 4.1 |
| Example I-2 | Good | Good | 510 | 4.0 |
| Example I-3 | Good | Good | 267 | 3.4 |
| Example I-4 | Good | Good | 442 | 4.3 |
| Example I-5 | Good | Good | 637 | 4.7 |
| Example I-6 | Good | Good | 470 | 4.9 |
| Comparative Example I-1 | Fair | Fair | 338 | 7.3 |
| Comparative Example I-2 | Poor | Poor | 431 | 7.0 |

Evaluation, "Fair" and "Poor" each is an unpractical range.

EXAMPLES I-7–I-12

Resistive element films were prepared in the same manner as in Example I-1 except that the weight ratio of Ir, Bi and Si was altered from Ir/Bi/Si=1/1/1 to that shown in Table I-3. The results of the sheet resistive value of the resistive element films thus obtained and its dispersion are shown in Table I-3.

Comparative Examples I-3–I-8

Resistive element films were prepared in the same manner as in Examples I-7 to I-12 except that pastes with the same viscosity as obtained in Examples I-7 to I-12 were prepared by adding α-terpineol to the concentrated mixture containing Ir, Bi and Si without addition of asphalt solution. The results of the sheet resistive value of the resistive element films thus-obtained and its dispersion are shown in Table I-3.

TABLE I-3

| | Composition ratio Ir/Bi/Si | Average resistive value (Ω/□) | Dispersion in resistive value (%) |
|---|---|---|---|
| Example | | | |
| I-7 | 1/2/1 | 1,236 | 4.0 |
| I-8 | 1/0.5/1 | 787 | 2.4 |
| I-9 | 0.5/1/1 | 1,401 | 4.4 |
| I-10 | 2/1/1 | 389 | 2.3 |
| I-11 | 1/1/0 | 1,370 | 5.1 |
| I-12 | 1/1/1.5 | 694 | 4.4 |
| Comparative Example | | | |
| I-3 | 1/2/1 | 1,140 | 8.9 |
| I-4 | 1/0.5/1 | 703 | 9.6 |
| I-5 | 0.5/1/1 | 1,259 | 8.8 |
| I-6 | 2/1/1 | 299 | 9.0 |
| I-7 | 1/1/0 | 1,300 | 10.2 |

TABLE I-3-continued

| | Composition ratio Ir/Bi/Si | Average resistive value (Ω/□) | Dispersion in resistive value (%) |
|---|---|---|---|
| I-8 | 1/1/1.5 | 623 | 8.2 |

EXAMPLES I-13–I-20

Resistive element films were prepared in the same manner as in Example I-1 except that the kind and weight ratio of the metal and non-metal were altered from Ir/Bi/Si =1/1/1 to those shown in Table I-4 and the pastes were prepared from the metal and non-metal resinates shown in Table I-4 with desired element composition ratios as calculated in terms of metal content in these resinates. The results of the sheet resistive value of the resistive element films thus-obtained and its dispersion are shown in Table I-4. The metal and non-metal resinates used are shown in Table I-5.

Comparative Examples I-9–I-16

Resistive element films were prepared in the same manner as in Examples I-13 to I-20 except that pastes with the same viscosity as obtained in Examples I-7 to I-12 were prepared by adding α-terpineol to the concentrated mixture containing organic metal and non-metal compounds without addition of asphalt solution. The results of the sheet resistive value of the resistive element films thus-obtained and its dispersion are shown in Table I-4.

TABLE I-4

| | Kind of metal and non-metal and composition ratio | Average resistive value (Ω/□) | Dispersion in resistive value (%) |
|---|---|---|---|
| Example | | | |
| I-13 | Ru/Si/Bi 1/1/0.1 | 2.8 | 7.1 |
| I-14 | Ru/Ba 1/1 | 35 | 8.4 |
| I-15 | Rh/Si/Bi 1/0.5/0.5 | 1.5 | 5.4 |
| I-16 | Rh/Si/Bi/B 1/0.5/0.5/0.5 | 4.6 | 6.5 |
| I-17 | Rh/Si/Pb/Ti 1/0.5/0.5/0.3 | 10.3 | 6.4 |
| I-18 | Rh/Si/Bi/Sn 1/0.5/0.5/0.3 | 2.6 | 7.3 |
| I-19 | Pd/Si/Pb 1/0.5/0.5 | 1.4 | 8.2 |
| I-20 | Pt/Si/Pb 1/0.5/0.5 | 1.6 | 9.4 |
| Comparative Example | | | |
| I-9 | Ru/Si/Bi 1/1/0.1 | 2.5 | 10.5 |
| I-10 | Ru/Ba 1/1 | 30 | 11.3 |
| I-11 | Rh/Si/Bi 110.5/0.5 | 1.2 | 9.4 |
| I-12 | Rh/Si/Bi/B 1/0.5/0.5/0.5 | 4.4 | 11.5 |
| I-13 | Rh/Si/Pb/Ti 1/0.5/0.5/0.3 | 9.9 | 10.8 |
| I-14 | Rh/Si/Bi/Sn 1/0.5/0.5/0.3 | 2.4 | 12.5 |
| I-15 | Pd/Si/Pb 1/0.5/0.5 | 1.2 | 15.3 |
| I-16 | Pt/Si/Pb 1/0.5/0.5 | 1.5 | 14.8 |

TABLE I-5

| Kind of metal and non-metal | Resinate No. | Kind of metal and non-metal | Resinate No. |
|---|---|---|---|
| Ru | A-1124 (produced by N.E. CHEMCAT CORP.) | B | #11-A (produced by N.E. CHEMCAT CORP.) |
| Rh | #8826 (produced by N.E. CHEMCAT CORP.) | Ti | #9428 (produced by N.E. CHEMCAT CORP.) |
| Pd | #7611 (produced by N.E. CHEMCAT CORP.) | Pb | #207-A (produced by N.E. CHEMCAT CORP.) |
| Pt | #9450 (produced by N.E. CHEMCAT CORP.) | Sn | #118-B (produced by N.E. CHEMCAT CORP.) |
| Bi | #8365 (produced by N.E. CHEMCAT CORP.) | Ba | #137-C (produced by N.E. CHEMCAT CORP.) |
| Si | #28-FC (produced by N.E. CHEMCAT CORP.) | — | — |

EXAMPLE I-21

A paste was prepared in the same manner as in Example I-2 except that the asphalt solution was filtered. In the filtration of the asphalt solution, the asphalt solution was put into a 500-ml injector, and the asphalt solution was then filtered with an effective filtering area of 0.8 $cm^2$ through a disposable filter having a mesh size of 0.45 μm ("Chromatodisc 25N" (material: PTFE) produced by Kurashiki Spinning Co., Ltd.) attached to the tip of the injector. The asphalt solution thus-filtered was then used to prepare a paste in the same manner as in Example I-2. Thus, a resistive element film was obtained in the same manner as in Example I-2. The sheet resistive value of the resistive element film thus-obtained was 326 Ω/□, and its dispersion was 1.6%.

EXAMPLE I-22

7.39 g of iridium-2,2,6,6-tetramethyl-3,5-heptanedionate $\{Ir[(CH_3)_3CCOCCOC(CH_3)_3)_3]\}$, 6.39 g of bismuth 2-ethylhexanate $\{[Bi(OOCC_7H_{15})_3\}$, and 1.38 g of poly(ditolylsiloxane)$\{[SiO(C_6H_4CH_3)_2]n\}$ as organic metal and non-metal compounds were dissolved in 30 ml of a mixture of α-terpineol and butyl carbitol acetate. To the solution was added 15 g of the asphalt solution used in Example I-2 with stirring to obtain a paste. A resistive element film was prepared from this paste in the same manner as in Example I-1. The sheet resistive value of the resistive element film was 752 Ω/□, and its dispersion was 4.7%.

Comparative Example I-17

7.39 g of iridium-2,2,6,6-tetramethyl-3,5-heptanedionate $\{Ir[(CH_3)_3CCOCCOC(CH_3)_3)_3]\}$, 6.39 g of bismuth 2-ethylhexanate $\{[Bi(OOCC_7H_{15})_3\}$, and 1.38 g of poly(ditolylsiloxane)$\{[SiO(C_6H_4CH_3)_2]n\}$ as organic metal and non-metal compounds were dissolved in 30 ml of a mixture of α-terpineol and butyl carbitol acetate. A resistive element film was prepared from this solution in the same manner as in Example I-1. The sheet resistive value of the resistive element film was 704 Ω/□, and its dispersion was 8.9%.

The present invention features that the mixing of a solution of asphalt dissolved in a solvent provides a uniform paste with a viscosity and thixotropic properties suitable for coating which gives a film having excellent surface properties and a reduced dispersion in the thickness when coated and then gives a resistive element film having a reduced dispersion in the resistive value after calcined. Another effect of the addition of asphalt is that the film-forming properties of the resistive element film can be improved upon calcination.

In the present invention, when the resistive element film-forming paste is prepared, the kind and composition ratio of the organic metal compound and the organic metal or non-metal compound as an additive can be easily altered. Thus, the resistive value can be easily controlled. The resistive element film thus obtained can be applied to thermal heads and various electronic components such as hybrid integrated circuit.

EXAMPLES II-1–II-5

As organic metal and non-metal compounds there were used the following metal and non-metal resinates:

| | |
|---|---|
| Ir resinate (A-1123: produced by N.E. CHEMCAT CORP.; metal content: 6.0 wt %) | 21.12 g |
| Bi resinate (#8365: produced by N.E. CHEMCAT CORP.; metal content: 20.0 wt %) | 6.89 g |
| Si resinate (#28FC: produced by N.E. CHEMCAT CORP.; metal content: 9.3 wt %) | 2.00 g |

The above mentioned metal and non-metal resinates (Ir/Bi/Si=1/1/1 as calculated in terms of metal content in the resinates) were mixed. The mixture was then concentrated in a 100° C. dryer until the weight thereof was decreased to 60%. To 18 g of the thus concentrated mixture containing Ir, Bi and Si was added 12.0 g of the asphalt solution described later as a viscosity adjuster with stirring. The material was then further concentrated or diluted with α-terpineol to a desired viscosity to obtain screen printing pastes with viscosities shown in Table II-1.

The pastes thus-obtained were each screen-printed on a 1 in.×1 in. alumina substrate (GS-6, produced by Kyocera Corp.) by means of a printer (PRESCO 8115, produced by AFFILATED MANUFACTURES, INC.), dried at a temperature of 70° C. for 30 minutes, and then calcined at a temperature of 800° C. for 15 minutes to obtain resistive element films.

The average sheet resistive value of the resistive element film and its dispersion were taken from the value of five specimens. The results of the sheet resistive value, the dispersion in the resistive values, and max/min of resistive values (ratio of the difference between max. of resistive value and the average resistive value to the difference between min. of resistive value and the average resistive value) are shown in Table II-3. The dispersion in the resistive value is obtained by dividing the standard deviation of resistive values by the average resistive value.

The asphalt solution as a viscosity adjuster was prepared by heating 150 g of asphalt (Fine Powder, produced by Tokyo Kasei K.K.) and 600 ml of α-terpineol (produced by Tokyo Kasei K.K.) to a temperature of 150° C. with stirring for 3 hours, and then to 500 ml of the solution thus-prepared was added 25 g of 2,2,4-trimethyl-pentane-1,3-diol-monobutyl ester (produced by Chisso Corporation).

TABLE II-1

| | Viscosity adjustment | Viscosity (cp) |
|---|---|---|
| Example II-1 | 4 wt % of α-terpineol added | 4,000 |
| Example II-2 | Concentrated by 1 wt % | 8,000 |
| Example II-3 | Concentrated by 3 wt % | 10,300 |
| Example II-4 | Concentrated by 4 wt % | 12,500 |
| Example II-5 | Concentrated by 8 wt % | 21,900 |

Comparative Examples II-1–II-3

Pastes were prepared in the same manner as in Examples II-1 to II-5 except that the viscosity thereof were adjusted to those shown in Table II-2, respectively. The pastes thus-obtained were each screen- printed on a 1 in.×1 in. alumina substrate (GS-6, produced by Kyocera Corp.), dried at a temperature of 70° C. for 30 minutes, and then calcined at a temperature of 800° C. for 15 minutes to obtain resistive element films. The sheet resistive value of the resistive element film and its dispersion are shown in Table II-3.

| | Viscosity adjustment | Viscosity (cp) |
|---|---|---|
| Comparative Example II-1 | Concentrated by 11.5 wt % | 39,230 |
| Comparative Example II-2 | Concentrated by 13 wt % | 176,710 |
| Comparative Example II-3 | 11 wt % of α-terpineol added | 1,530 |

As shown in Table II-3, as the viscosity increases, a tendency appears that the dispersion in the resistive value and max/min of resistive value increase. Furthermore, as the viscosity decreases, a tendency appears that max/min of resistive value increases. The relationship between viscosity and resistive value in Examples II-1 to II-5 and Comparative Examples II-1 to II-3 are shown in FIG. 1. The viscosity range suitable for resistive element is from 3,000 cp to 30,000 cp.

TABLE II-3

| | Average resistive value (Ω/□) | Dispersionin resistive value (%) | Max/min of resistive value (%) |
|---|---|---|---|
| Example II-1 | 1,630 | 4.2 | +4.1/−7.4 |
| Example II-2 | 864 | 3.2 | +3.4/−5.5 |
| Example II-3 | 743 | 1.9 | +3.8./−5.4 |
| Example II-4 | 713 | 2.5 | +2.5/−4.7 |
| Example II-5 | 815 | 4.2 | +4.3/−7.9 |
| Comparative Example II-1 | 1,232 | 6.8 | +7.5/−12.1 |
| Comparative Example II-2 | 1,019 | 11.9 | +20.3/−13.2 |
| Comparative Example II-3 | 728 | 6.4 | +9.6/−7.5 |

EXAMPLES II-6–II-8/Comparative Examples II–4 and II-5

To 18 g of the concentrated mixture containing organic metal and non-metal compounds (Ir, Bi, Si) as obtained in Examples II-1 to II-5 was added 1.00 g of a Dehyzole R (anionic vegetable oil derivative, produced by Sannopco Corp.) as a viscosity adjuster. The material was then diluted with butyl carbitol acetate (BCA) to a pre-determined viscosity to obtain a screen printing paste with a viscosity shown in Table II-4. The paste thus-obtained was then used to prepare a resistive element film in the same manner as in Examples II-1 to II-5. The average resistive value of the sheet resistor and the dispersion in the resistive values were taken from five specimens. The sheet resistive value of the resistive element film, dispersion in the resistive values, and max/min of resistive value are shown in Table II-5.

TABLE II-4

| | Viscosity adjustment | Viscosity (cp) |
|---|---|---|
| Example II-6 | 27 wt % of butyl carbitol acetate (BCA) added | 4,750 |
| Example II-7 | 18 wt % of BCA added | 12,380 |
| Example II-8 | 14 wt % of BCA added | 20,000 |
| Comparative Example II-4 | 9 wt % of BCA added | 35,000 |
| Comparative Example II-5 | 32 wt % of BCA added | 2,620 |

TABLE II-5

| | Average resistive Value (Ω/□) | Dispersion in resistive value (%) | Max/min of resistive value (%) |
|---|---|---|---|
| Example II-6 | 287 | 3.9 | +6.2/−4.6 |
| Example II-7 | 252 | 4.2 | +6.5/−5.7 |
| Example II-8 | 266 | 4.3 | +8.6/−2.4 |
| Comparative Example II-4 | 340 | 6.9 | +9.2/−7.6 |
| Comparative Example II-5 | 324 | 13.2 | +12.9/−19.0 |

EXAMPLES II-9–II-11/COMPARATIVE EXAMPLE II-6

18 g of a mixture containing organic metal and non-metal compounds (Ir, Bi, Si) which had been concentrated in the same manner as in Examples II-1 to II-5 was diluted with butyl carbitol acetate (BCA) to predetermined viscosities to prepare screen printing pastes with viscosities as shown in Table II-6. The pastes thus-obtained were then used to prepare resistive element films in the same manner as in Examples II-1 to II-5. The average resistive value of the sheet resistor and the dispersion in the resistive values were taken from five specimens. The sheet resistive value of the resistive element film, dispersion in the resistive values, and max/min of resistive value are shown in Table II-6.

TABLE II-6

| | Viscosity adjustment | Viscosity (cp) | Average resistive value (Ω/□) | Dispersion in resistive value (%) | Max/min of resistive value (%) |
|---|---|---|---|---|---|
| Example II-9 | 12 wt % of BCA added | 3,000 | 320 | 3.5 | +3.9/−5.9 |
| Example II-10 | 5 wt % of BCA added | 6,790 | 209 | 4.7 | +6.7/−7.6 |
| Example II-11 | 1 wt % of BCA added | 12,300 | 236 | 4.4 | +7.6/−4.3 |
| Comparative Example II-6 | 23 wt % of BCA | 1,530 | 485 | 11.9 | +16.9/−16.5 |

EXAMPLES II-12 and II-13/COMPARATIVE EXAMPLES II-7 and II-8

A solution containing organic metal and non-metal compounds was prepared as follows:

| | |
|---|---|
| Rh resinate (#8826: produced by N.E. CHEMCAT CORP.) | 5.2 g |
| Si resinate (#28FC: produced by | 17.6 g |

-continued

| | |
|---|---|
| N.E. CHEMCAT CORP.) | |
| Pb resinate (#207-1: produced by N.E. CHEMCAT CORP.) | 7.2 g |

The above metal and non-metal resinates (Rh/Si/Pb=1/1/1 as calculated in terms of metal content in the resinates) were mixed. The mixture was then concentrated in a 100° C. dryer until the weight thereof was decreased to 60 wt %. To 18 g of the thus-concentrated mixture containing Rh, Si and Pb was added 12.0 g of the asphalt solution as described in Examples II-1 to II-5 with stirring. The material was then further concentrated or diluted with α-terpineol to a predetermined viscosity to obtain screen printing pastes with viscosities shown in Table II-7. The pastes thus obtained were then used to prepare resistive element films in the same manner as in Examples II-1 to II-5. The sheet resistive value of the resistive element film, dispersion in the resistive values, and max/min of resistive value were determined. The results are shown in Table II-7.

TABLE II-7

| | Viscosity adjustment | Viscosity (cp) | Average resistive value (Ω/□) | Dispersion in resistive value (%) | Max/min of resistive value (%) |
|---|---|---|---|---|---|
| Example II-12 | 3 wt % of terpineol added | 5,200 | 7.3 | 6.8 | +5.6/−4.5 |
| Example II-13 | Concentrated by 9 wt % | 23,000 | 7.1 | 7.5 | +6.5/−3.9 |
| Comparative Example II-7 | 7 wt % of terpineol added | 2,140 | 7.6 | 18.3 | +15.8/−20.2 |
| Comparative Example II-8 | Concentrated by 14 wt % | 38,000 | 6.5 | 12.9 | +10.5/−12.8 |

In the above examples, the process for the coating of the resistive element paste has been described with reference to screen printing, but the present invention is not limited thereto. The resistive element paste may be coated entirely on a substrate by a coating method commonly used in the thick film-forming process, such as spin coating process, roll coating process and dip coating process, calcined, and then etched to form a resistive element having a desired shape. Alternatively, a direct drawing method such as ink jet process may be used.

When a resistive element film having a viscosity range of the present invention is coated on a substrate, a resistive element film with excellent surface properties and a reduced dispersion in the thickness can be obtained. The resistive element film thus obtained exhibits stable properties and can be used for hybrid integrated circuits or other various electronic components.

EXAMPLE III-1

As paste materials, Ir resinate (A-1123), Si resinate (#28FC) and Bi resinate (#8365) produced by N.E. CHEMCAT CORP. were mixed in an atomic proportion of 1:1:1. A terpineol extract of asphalt was added to the system in an amount of 40% by weight based on the total weight of the resinates. The mixture was then diluted with terpineol and concentrated to a viscosity of 5,000 to 30,000 cp. The resistive element-forming paste thus-obtained was then printed on a glazed ceramic substrate (NK217: produced by Noritake Company Limited) through a stainless screen with a mesh size of 150 to 400, dried at a temperature of 120° C., and then calcined at a temperature of 500° C. to 800° C. in an infrared belt calcining furnace for about 10 minutes to form a resistive element film thereon.

The resistive element thus obtained had a size of 8 mm×230 mm, a film thickness of 0.1 to 0.4 μm and a surface resistivity of 530 Ω/□±1.1% (at a film thickness of 0.4 μm). The measurement of the surface resistivity of the resistive element film was effected by means of a Type MCP-T400 surface resistivity meter produced by Mitsubishi Petrochemical Company Limited. The surface resistivity was measured at an interval of 1 mm in the longitudinal direction. The dispersion in the resistive value was obtained by dividing the standard deviation of resistive values by the average resistive value. The resistive element was cut across the resistive element film. When the section of the resistive element film was observed under a transmission type electron microscope, it was confirmed that the film has a structure such that finely divided grains having a dimeter of 10 to 100 Å are laminated in layers.

This resistive element was then used to prepare a thermal head. The thermal head thus-obtained exhibited a high resistance to electric power and a high resistance voltage as compared with those prepared according to the conventional thick film-forming process.

EXAMPLE III-2

As paste materials, Rh resinate (#8826), Si resinate (#28FC) and Pb resinate (#207-A) produced by N.E. CHEMCAT CORP. were mixed in an atomic proportion of 1:1:0.5. A terpineol extract of asphalt was added to the system in an amount of 40% by weight based on the total weight of the resinates. The mixture was then diluted with terpineol to a viscosity of about 5,000 cp. A resistive element film was prepared from this paste in the same manner as in Example III-1. The resistive element thus obtained had a thickness of 0.37 μm and a surface resistivity of 5 kΩ/□±2.5%. When the section of the resistive element film was observed under a transmission type electron microscope, it was confirmed that the film has a structure such that finely divided grains having a dimeter of 100 Å or less are laminated in layers.

EXAMPLE III-3

As paste materials, Pd resinate (#7611), Si resinate (#28FC) and Bi resinate (#8365) produced by N.E. CHEMCAT CORP. were mixed in an atomic proportion of 1:1:0.5. A terpineol extract of asphalt was added to the system in an amount of 40% by weight based on the total weight of the resinates. The mixture was then diluted with terpineol to a viscosity of about 5,000 cp. A resistive element film was prepared from this paste in the same manner as in Example III-1. The resistive element thus-obtained had a thickness of 0.40 μm and a surface resistivity of 8.5 kΩ/□±2.0%. When the section of the resistive element film was observed under a transmission type electron microscope, it was confirmed that the film has a structure such that finely divided grains having a dimeter of 100 Å or less are laminated in layers.

EXAMPLE III-4

As paste materials, Pt resinate (#9450), Ca resinate (40B) and Pb resinate (#207-A) produced by N.E. CHEMCAT CORP. were mixed in an atomic proportion of 1:0.5: 0.5. A terpineol extract of asphalt was added to the system in an amount of 40% by weight based on the total weight of the resinares. 2,2,4-trimethyl-pentane-1,3-diolmonobutyl ester was added to the system as a printability improver in an amount of 2% by weight. The system was then diluted with terpineol to a viscosity of about 5,000 cp. A resistive element film was prepared from this paste in the same manner as in Example III-1. The resistive element film thus-obtained had a thickness of 0.36 μm and a surface resistivity of 1.2 kΩ/□±3.0%. The resistive element film comprised grains having a diameter of 100 Å or less and thus had a smooth surface.

Comparative Example III-1

A resistive element film was prepared in the same manner as in Example III-1 except that a ruthenium oxide paste (GZX-0.5K produced by TANAKA KIKINZOKU INTERNATIONAL K.K.) as thick resistive element film-forming paste was used. The resistive element film thus-obtained had a thickness of about 10 μm and exhibited a surface resistivity of 510 Ω/□±20%. Thus, the resistive element film exhibited a resistive value dispersion of about ten times that of the specimen in the above examples of the present invention.

When this resistive element film was measured for grain diameter in the same manner as in Example III-1, it was found that it was made of resistive element grains with a diameter of 0.1 to 1 μm. This resistive element was then used to prepare a thermal head. However, this thermal head couldn't give a sufficient print quality.

In the above examples, the process for the coating of the resistive element paste has been described with reference to screen printing, but the present invention is not limited thereto. The resistive element paste may be coated entirely on a substrate by a coating method commonly used in the thick film-forming process, such as spin coating process, roll coating process and dip coating process, calcined, and then etched to form a resistive element having a desired shape. Alternatively, a direct drawing method such as ink jet process may be used.

The resistive element prepared according to the present invention exhibits a remarkably improved uniformity in the resistive element film and hence a drastically reduced dispersion in the resistive value as compared with the conventional resistive elements. Thus, the resistive element of the present invention can be used as a heating resistive element for thermal head requiring a high resolution or multiple gradation.

As organic metal compound solutions to be used in the following examples, there were used Metal Resinates (trade name of products of N.E. CHEMCAT CORP.) indicated by the following reference numbers:

Ir . . . A-1123, Si . . . #28-FC, Bi . . . #8365, Pb . . . #207-A, Al . . . A3808, Zr . . . #5437, Ca . . . 40B, Sn . . . #118B, B . . . #11-A, Ti . . . #9428, Ba . . . #137-C

EXAMPLE IV-1

A-1123 and #28-FC were mixed in such an atomic proportion that Ir:Si:Bi is 1:1:2. The mixture was then diluted with a solution extracted from asphalt with a solvent such as α-terpineol and butyl carbitol acetate to a viscosity of 3,000 to 30,000 cps. The mixture thus prepared was then printed on a glazed alumina substrate comprising alumina coated with glass through a stainless screen with a mesh size of 100 to 400, dried at a temperature of 120° C., and then calcined at a peak temperature of 800° C. in an infrared belt calcining furnace for 10 minutes to form a resistive element film thereon.

The resistive element film thus-formed had a thickness of 0.03 to 0.7 μm and a sheet resistive value of 1.7KΩ/□±2.2% as calculated in terms of film thickness of 0.2 mm. The dispersion in the resistive value was obtained by dividing the standard deviation of resistive values by the average resistive value.

EXAMPLE IV-2

A resistive element film was prepared in the same manner as in Example IV-1 except that A-1123, #28-FC and #118B were mixed in such an atomic proportion that Ir:Si:Sn is 1:1:2. The resistive element film thus-formed had a thickness of 0.05 to 0.8 μm and a sheet resistive value of 1.4KΩ/□±2.3% as calculated in terms of a film thickness of 0.2 mm.

EXAMPLE IV-3

A resistive element film was prepared in the same manner as in Example IV-1 except that A-1123, #28-FC, #207-A, and #11-A were mixed in such an atomic proportion that Ir :Si:Pb:B is 1:2:2:1. The resistive element film thus-formed had a thickness of 0.05 to 0.8 μm and a sheet resistive value of 45KΩ/□±1.4% as calculated in terms of a film thickness of 0.2 mm.

EXAMPLE IV-4

A resistive element film was prepared in the same manner as in Example IV-1 except that A-1123, #28-FC, #8365 and 40B were mixed in such an atomic proportion that Ir: Si:Bi:Ca is 1:2:1:1. The resistive element film thus-formed had a thickness of 0.05 to 0.7 μm and a sheet resistive value of 30KΩ/□±1.8% as calculated in terms of a film thickness of 0.2 mm.

EXAMPLE IV-5

A resistive element film was prepared in the same manner as in Example IV-1 except that A-1123, #28-FC, #118B and A3808 were mixed in such an atomic proportion that Ir Si:Sn:Al is 1:2:1:2. The resistive element film thus-formed had a thickness of 0.05 to 0.6 μm and a sheet resistive value of 41KΩ/□±1.9% as calculated in terms of film thickness of 0.2 mm.

Comparative Example IV-1

A resistive element film was prepared in the same manner as in Example IV-1 except that A-1123, #28-FC, and #8365 were mixed in such an atomic proportion that Ir: Si Bi is 1:3:3. However, an island shaped resistive element film was formed which couldn't be measured for resistive value (limit of measurement is 100KΩ).

In the above examples, the process for the coating of the resistive element paste has been described with reference to screen printing, but the present invention is not limited thereto. The resistive element paste may be coated entirely on a substrate by a coating method commonly used in the thick film-forming process, such as spin coating process, roll coating process and dip coating process, calcined, and then etched to form a resistive element having a desired shape. Alternatively, a direct drawing method such as ink jet process may be used.

The resistive element film prepared according to the present invention exhibits a reduced dispersion in the resistive value and a high resistive value and thus can be used in electronic components such as hybrid integrated circuit and thermal head. The range of resistive value required by these applications can be widely varied. The present invention has the following features:

1. A higher resistive value than that obtained with the conventional composition ratio can be easily accomplished with the same materials (expansion of resistive value range).
2. In the application to heating resistive elements such as thermal head, when used as a high resistivity resistive element, if the same amount of heat is generated as conventional, a reduced consumption of electric power is required. Furthermore, as a driving IV there can be used a general-purpose IC instead of an expensive high voltage IC, reducing the cost.

While the invention has been described in detail and with reference to specific embodiments thereof, it will be apparent to one skilled in the art that various changes and modifications can be made therein without departing from the spirit and scope thereof.

What is claimed is:

1. A resistive element film-forming paste, which comprises (1) an organic metal compound, (2) at least one additive selected from organic nonmetal compounds and organic metal compounds, and (3) a solution of asphalt dissolved in a solvent.

2. A resistive element film-forming paste as claimed in claim 1, wherein said asphalt solution is filtered before use.

3. A resistive element film-forming paste as claimed in claim 1, wherein said resistive element film-forming paste has a viscosity ranging from 3,000 to 30,000 cp.

4. A resistive element film-forming paste as claimed in claim 1, wherein said organic metal compound (1) is at least one compound selected from the group consisting of organic compounds of ruthenium (Ru), iridium (Ir), rhodium (Rh), platinum (Pt), palladium (Pd) and osmium (Os) and said at least one additive (2) consists of at least one compound selected from the group consisting of silicon (Si), bismuth (Bi), lead (Pb), tin (Sn), aluminum (Al), boron (B), titanium (Ti), zirconium (Zr), calcium (Ca) and barium (Ba).

5. A resistive element film-forming paste as claimed in claim 1, wherein said asphalt solution consists essentially of asphalt dissolved in a solvent.

6. A resistive element film-forming paste as claimed in claim 1, wherein said resistive element film-forming paste does not contain glass powder.

7. A resistive element film-forming material, which comprises (1) an organic iridium (Ir) compound, (2) a compound containing at least one element (M) selected from the group consisting of silicon (Si), bismuth (Bi), lead (Pb), aluminum (Al), zirconium (Zr), calcium (Ca), tin (Sn), boron (B), titanium (Ti) and barium (Ba), with a ratio of atoms in said elements (M) to atoms in said organic iridium (Ir) compound ranging from 2.7 to 5, and (3) a solution of asphalt dissolved in a solvent.

8. A resistive element film-forming material as claimed in claim 7, wherein said asphalt solution consists essentially of asphalt dissolved in a solvent.

9. A resistive element film-forming material as claimed in claim 8, wherein said ratio of atoms in said elements (M) to iridium atoms in said organic iridium (Ir) compound ranges from 3 to 5.

10. A resistive element film-forming material as claimed in claim 7, wherein said resistive element film-forming material does not contain glass powder.

11. A resistive element, formed by a process which comprises coating a resistive element film-forming paste comprising (1) an organic metal compound, (2) at least one organic nonmetal additive, and (3) a solution of asphalt dissolved in a solvent on a substrate, and then calcining the paste.

12. A resistive element according to claim 11, wherein said calcining forms a resistive element film on said substrate, said resistive element film comprising finely divided resistive element grains with a diameter of 100 Å or less.

13. An electronic component, comprising a resistive element formed by a process which comprises coating a resistive element film-forming paste comprising (1) an organic metal compound, (2) at least one organic nonmetal additive, and (3) a solution of asphalt dissolved in a solvent on a substrate, and then calcining the paste.

14. An electronic component according to claim 13, wherein said calcining of the paste produces a resistive element film, said resistive element film comprising finely divided resistive element grains with a diameter of 100 Å or less.

15. A resistive element, formed by a process which comprises coating on a substrate a resistive element film-forming material, which comprises (1) an organic iridium (Ir) compound, (2) a compound containing at least one element (M) selected from the group consisting of silicon (Si), bismuth (Bi), lead (Pb), aluminum (Al), zirconium (Zr), calcium (Ca), tin (Sn), boron (B), titanium (Ti) and barium (Ba), with a ratio of atoms in said elements (M) to iridium atoms in said organic iridium (Ir) compound ranging from 2.7 to 5, and (3) a solution of asphalt dissolved in a solvent, and then calcining the material.

16. A thermal head, comprising (1) a substrate, (2) a thin glass film provided on said substrate, and (3) a resistive element film provided on said thin glass film and having a means of conducting electric current to said resistive element film, wherein said resistive element film is formed by a process which comprises coating on said thin glass film a resistive element film-forming material comprising an organic iridium (Ir) compound, a compound containing at least one element (M) selected from the group consisting of silicon (Si), bismuth (Bi), lead (Pb), aluminum (Al), zirconium (Zr), calcium (Ca), tin (Sn), boron (B), titanium (Ti) and barium (Ba), with a ratio of atoms in said elements (M) to iridium atoms in said organic iridium (Ir) compound ranging from 2.7 to 5, and a solution of asphalt dissolved in a solvent, and then calcining the material.

17. A thermal head according to claim 16, wherein said resistive element film comprises finely divided resistive element grains with a diameter of 100 Å or less.

18. A resistive element film-forming material, which comprises (1) an organic iridium (Ir) compound, (2) a compound containing at least one element (M) selected from the group consisting of silicon (Si), bismuth (Bi), lead (Pb), aluminum (Al), zirconium (Zr), calcium (Ca), tin (Sn), boron (B), titanium (Ti) and barium (Ba), and (3) a solution of asphalt dissolved in a solvent, with a ratio of atoms in said elements (M) to atoms in said organic iridium (Ir) compound ranging from 3 to 5.

* * * * *